US006029269A

United States Patent [19]

El-Soudani

[11] Patent Number: 6,029,269

[45] Date of Patent: Feb. 29, 2000

[54] BALLISTIC-RESISTANT HELMET AND METHOD FOR PRODUCING THE SAME

[75] Inventor: Sami M. El-Soudani, Cerritos, Calif.

[73] Assignee: Boeing North American, Inc., Seal Beach, Calif.

[21] Appl. No.: 08/995,436

[22] Filed: Dec. 22, 1997

[51] Int. Cl.[7] ..... A41H 1/04; A42B 3/06

[52] U.S. Cl. ..... 2/2.5; 2/410; 2/412; 72/349; 72/709; 29/421.1; 29/557; 29/DIG. 45

[58] Field of Search ..... 2/410, 411, 412, 2/2.5, 6.6; 72/348, 709; 29/419.1, 421.1, 557, 558, DIG. 45

[56] References Cited

U.S. PATENT DOCUMENTS

| | | | |
|---|---|---|---|
| 3,774,430 | 11/1973 | Greer et al. | 72/60 |
| 3,859,399 | 1/1975 | Bailey et al. | 264/29 |
| 3,871,026 | 3/1975 | Dorre | 2/6 |
| 4,090,011 | 5/1978 | Barkman et al. | 428/653 |
| 5,035,092 | 7/1991 | Bruinink et al. | 428/461 |
| 5,376,426 | 12/1994 | Harpell et al. | 428/109 |
| 5,480,706 | 1/1996 | Li et al. | 428/113 |

*Primary Examiner*—Michael A. Neas
*Attorney, Agent, or Firm*—Lawrence N. Ginsberg

[57] ABSTRACT

In one broad aspect the present invention comprises the steps of providing a titanium-based material preform and superplastically forming the preform to a final helmet shape. In another broad aspect, a first piece of fiber-reinforced titanium matrix composite material is hot isostatically pressed (HIP'ed) to form a side wall section. A second piece of fiber-reinforced titanium matrix composite material is hot pressed to form an upper dome section. The side wall section is then HIP/diffusion bonded to the upper dome section.

11 Claims, 8 Drawing Sheets

FIG. 13
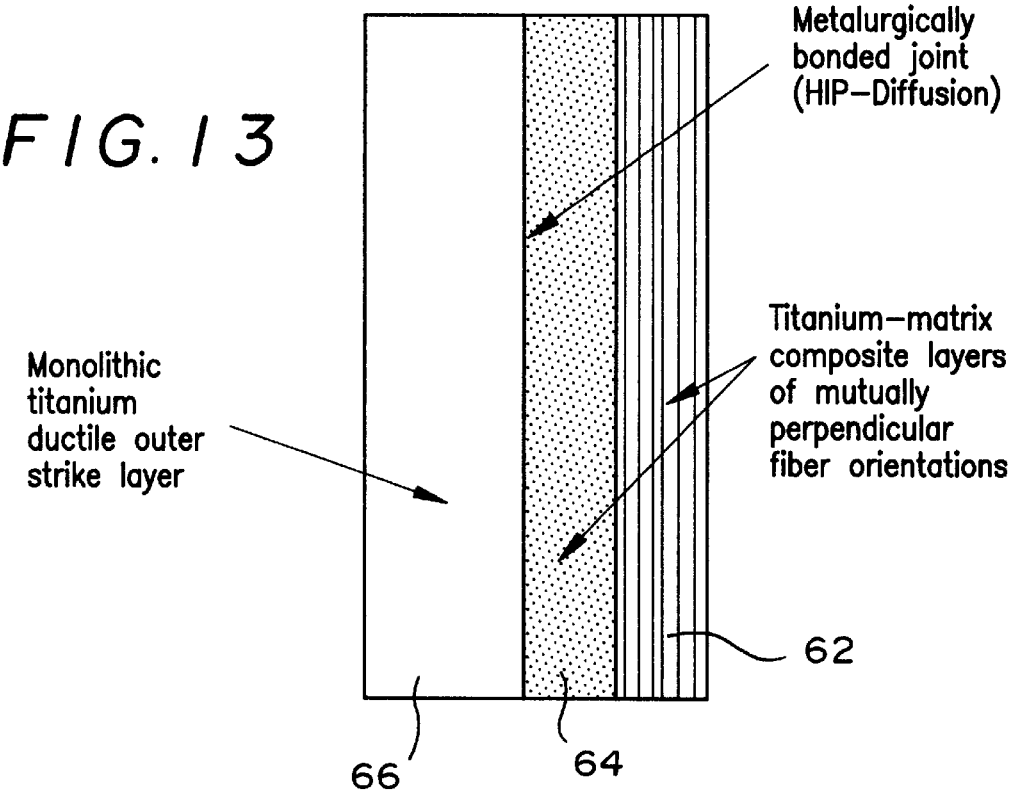
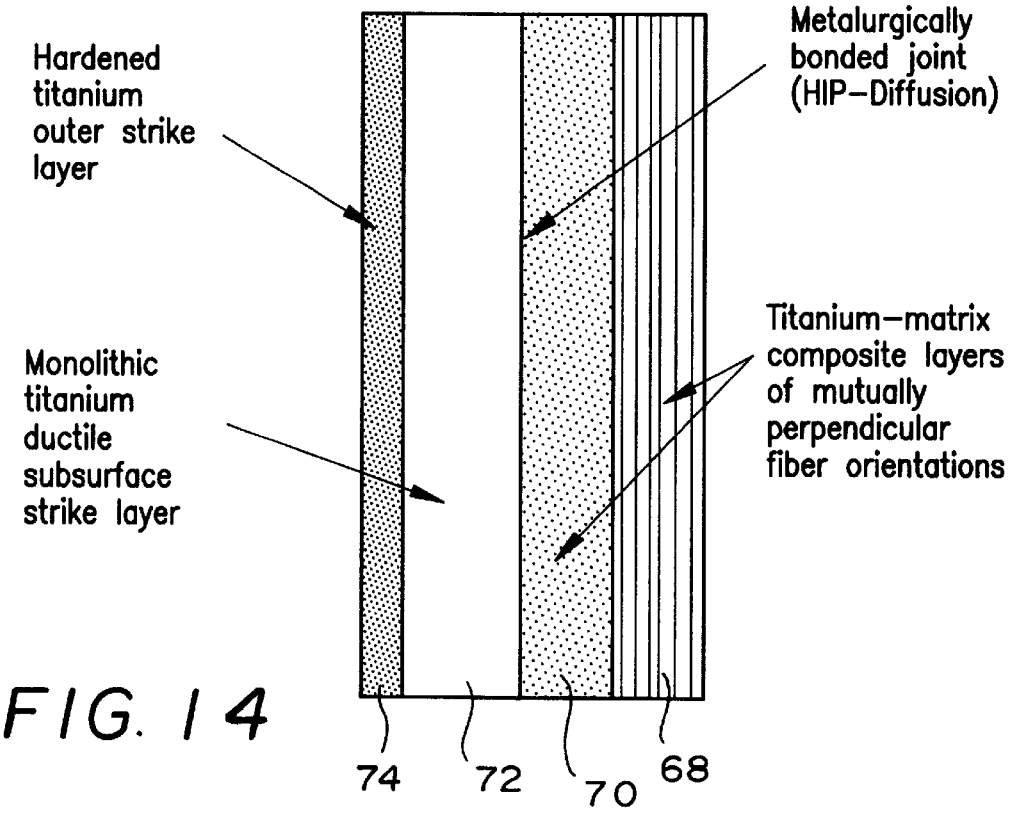
FIG. 14

BALLISTIC-RESISTANT HELMET AND METHOD FOR PRODUCING THE SAME

BACKGROUND OF THE INVENTION

1. Field of the Invention

The present invention relates to ballistic-resistant helmets and more particularly to a lightweight titanium-based helmet shell.

2. Description of the Related Art

There is an ever increasing demand for lighter, more protective and affordable ballistic-resistant helmets.

Existing helmets are made of either heavy metals, such as steel, non-metallic, composites, or a combination of both, and often fall short of defeating new advanced small arms threats such as a 7.62 mm ball with a muzzle velocity in the range of 1500 to 2836 feet per second (fps). More specifically, ground troop, steel helmets weighing 2.5 lbs. of 0.033-inch thick steel, fabricated per Military Standard MIL-H-1988G, are required to have a $V_p50$ ballistic limit of only 900 feet per second. If existing state-of-the-art helmet wall thicknesses were increased, in order to meet a current challenge, (i.e., in the ballistic velocity range of 1500 to 2836 fps, noted above) their associated specific weights and/or minimum thicknesses become unduly excessive, a fact which results in user discomfort and could lead to possible rejection or abandonment during critical field operations.

U.S. Pat. No. 5,035,952, issued to P. Bruinink et al., discloses a ballistic structure comprising the solid combination of the metal first layer and a second layer consisting of a composite fiber material containing fibers with the tensile strength of at least 2 GPa and a modulus of at least 20 GPa, based on polyethylene with a weight average molecular weight of at least $4\times10^5$ and a thermoplastic binding agent. A binding layer is applied between the first layer and the second layer, which binding layer contains the modified polyolefin. The first layer may consist of a metal or metal alloy such as steel, aluminum, or titanium.

U.S. Pat. No. 3,871,026, issued to E. Dorre, discloses a steel helmet, which is strengthened by coating its outer, generally convex face with a layer of ceramic particles deposited on the steel at a temperature above their sintering temperature, as by flame spraying or plasma spraying, if the ceramic material has a hardness value of at least 8 on the MOHS scale.

U.S. Pat. No. 3,774,430, issued to W. D. Greer et al. discloses a deep drawing technique for sheet metal into concave-convex forms. The sheet of material is placed over a die cavity. A ram made of malleable material, such as lead, forces the sheet into the cavity. The force of the ram, progressing inwardly from the edges of the sheet toward the center of the cavity, moves the sheet downward and inward into the cavity without appreciable change in the thickness of the material at any point. The sheet may thus be worked in cold condition, either in one or a succession of steps, without requiring heat treatment.

The following patents were also revealed in a patent search:

U.S. Pat. No. 5,376,426, issued to G. A. Harpell et al., entitled "Penetration and Blast Resistant Composites and Articles"; U.S. Pat. No. 3,859,399, issued to W. O. Bailey et al., entitled "Dense Composite Ceramic Bodies and Method for Their Production"; U.S. Pat. No. 4,090,011, issued to E. F. Barkman et al., entitled "Armor"; and, U.S. Pat. No. 5,480,706, issued to H. L. Lo et al., entitled "Fire Resistant Ballistic Resistant Composite Armor".

None of the aforementioned references discloses an effective technique for providing a deep draw for titanium-based materials, which can be utilized for the manufacture of helmet shells.

OBJECTS AND SUMMARY OF THE INVENTION

It is therefore a principal object of the present invention to provide a highly ballistic-resistant helmet, which is relatively light and affordable.

This is achieved by the present invention, which in one broad aspect, comprises the steps of providing a titanium-based material preform and superplastically forming the preform to a final helmet shape.

In another broad aspect, a first piece of fiber-reinforced titanium matrix composite material is hot isostatically pressed (HIP'ed) to form a side wall section. A second piece of fiber-reinforced titanium matrix composite material is hot pressed to form an upper dome section. The side wall section is then HIP/diffusion bonded to the upper dome section.

The first process described above, i.e. the superplastic forming technique, derives a particular advantage by its ability to meet deep drawing requirements of helmets.

The second process described above, derives a particular advantage of exceptional weight reduction by utilizing relatively low density materials.

Other objects, advantages and novel features of the present invention will become apparent from the following detailed description of the invention when considered in conjunction with the accompanying drawings.

BRIEF DESCRIPTION OF THE DRAWINGS

FIG. 13 is a cross-sectional view of a portion of the helmet of FIG. 12 with a ductile outer third layer.

FIG. 14 is a cross-sectional view of a portion of the TMC helmet of FIG. 12, utilizing a hardened outer strike-face sublayer.

The same elements or parts throughout the figures are designated by the same reference characters.

DETAILED DESCRIPTION OF THE PREFERRED EMBODIMENT

Figure 1:
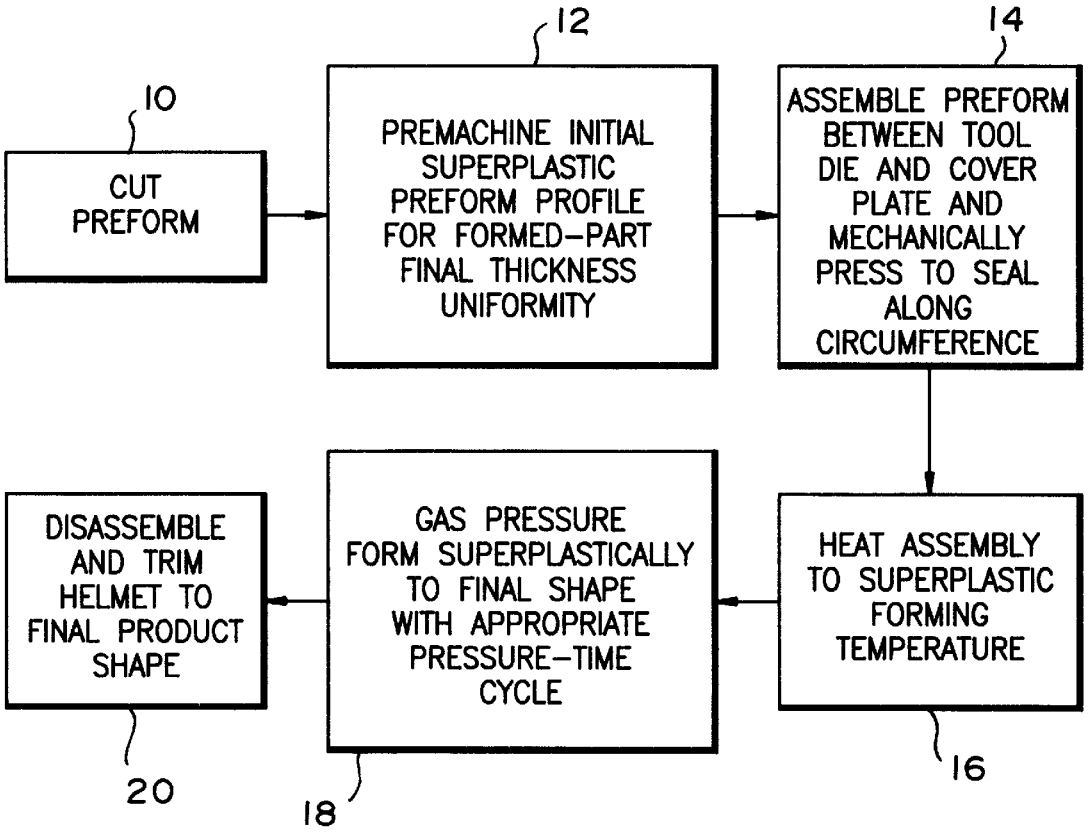
FIG. 1 is a block diagram showing the process steps of a first embodiment of the present invention in which a monolithic superplastically formed titanium helmet is produced.
Figure 2:
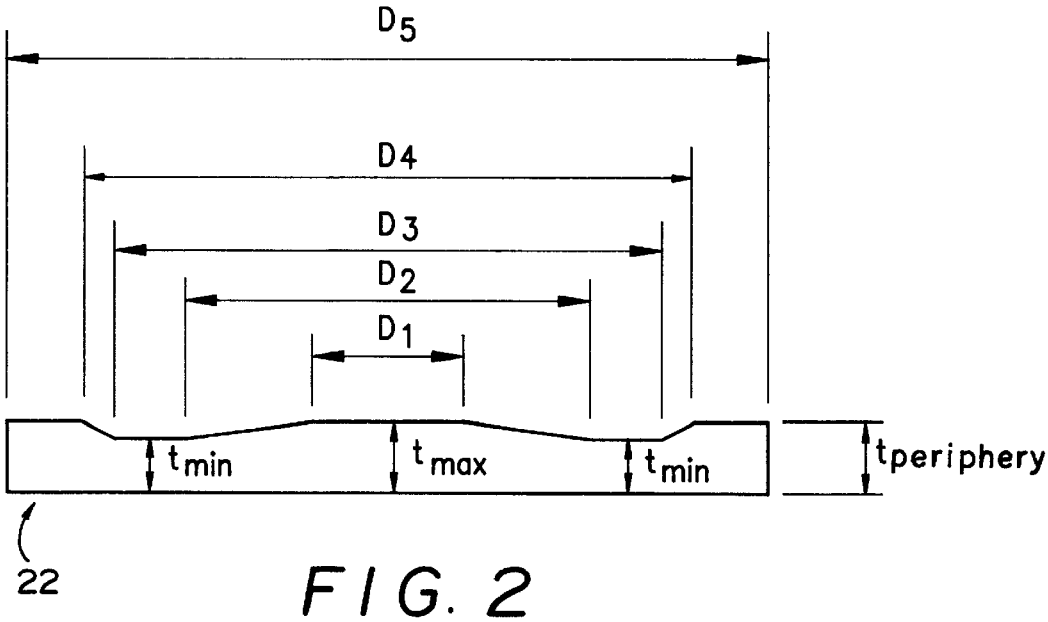
FIG. 2 is a cross-section of a circular preform used in the FIG. 1 process, with a female tool (die).

Referring now to the drawings and the characters of reference marked thereon, FIG. 1 illustrates a summary of the processing steps for producing a monolithic superplastically formed titanium helmet in accordance with the principles of the first embodiment of the present invention. A circular preform is cut from a titanium plate, as shown by process block 10. The preform is pre-machined (process block 12) to a specific profile (an example of which is shown in FIG. 2) in order to reduce the difference in the thickness' among various regions along the surface of the final formed part. The preform is mounted in the forming tool or die and mechanically pressed along a circumferential contour along the outer periphery to form a gaseous seal between the titanium plate and the die cover plate for subsequent gas pressure application in the space between these two components (process block 14). This will be discussed in detail below with respect to FIG. 3. The assembly is thermally insulated on the outside of the die, with a suitable fire-resistant fiber material. The assembly is then heated to the superplastic forming temperature upon which gradual pressure application within the cavity commences to form the part (process block 16).

The preform is gas-pressure formed superplastically, to the final shape with an appropriate pressure-time cycle (process block 18). The forming tool is then disassembled (process block 20) and the helmet trimmed to the final product shape, as will be discussed below with respect to FIG. 5.

Referring now to FIG. 2, a premachined titanium-based alloy preform is shown, designated by numeral designation 22. The preform 22 is premachined for use with a female die. It includes a central region $D_1$ which is "relatively thick". A central tapering region extending to diameter $D_2$ is about the central region $D_1$. A near periphery region extending to $D_3$ is about the central tapering region. The near periphery region is "relatively thin". A peripheral tapering region extending to $D_4$ is about the near periphery. A periphery region extending to $D_5$ is about peripheral tapering region. The periphery region is "relatively thick".

As used above, the term "relatively thick" refers broadly to a range from about 0.15 inches to 0.50 inches. The preferred range is about 0.2 inches to about 0.4 inches.

The term "relatively thin" refers to a broad range of about 0.085 inches to about 0.375 inches, preferably a range of about 0.10 inches to about 0.315 inches.

$D_1$ is preferably in a range of about 2 to 6 inches, $D_2$ is in a range of preferably about 7 to 11 inches and $D_3$ is in a range of about 9 to 13 inches. $D_4$ is preferably in a range of about 11 to 15 inches, and $D_5$ is about preferably in a range of about 14 to 16 inches.

Figure 3:
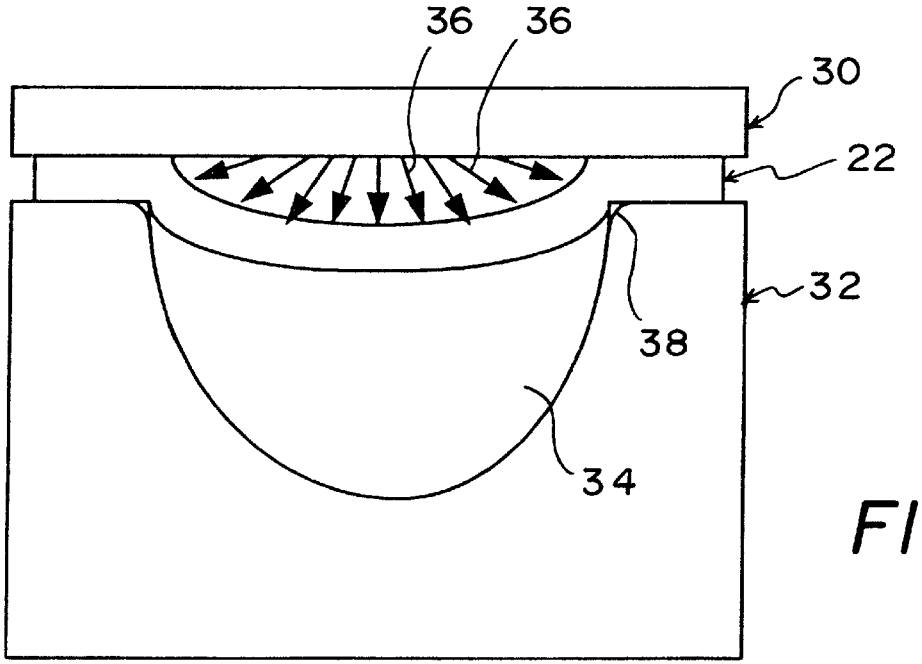
FIG. 3 is a schematic cross-section of a female-tool superplastic forming (SPF) assembly, implementing the process of FIG. 1.

Referring now to FIG. 3, the preform 22 is mounted between a cover plate 30 and a female die 32 having a desired helmet profile 34. Gas pressure, denoted by arrows 36, exerts the forming force. The gas is typically an inert gas such as argon. The gas is supplied via conduits (not shown) through the cover plate 30 as is well know in the field of superplastic forming. There are also gas release holes through the bottom of the female tool 32. (These conduits are also not shown.)

Corner radius limits, and the initial tool "draft angle", which is the slope relative to a vertical line, should be such as to minimize friction and part corner rupture during superplastic forming.

Figure 4:
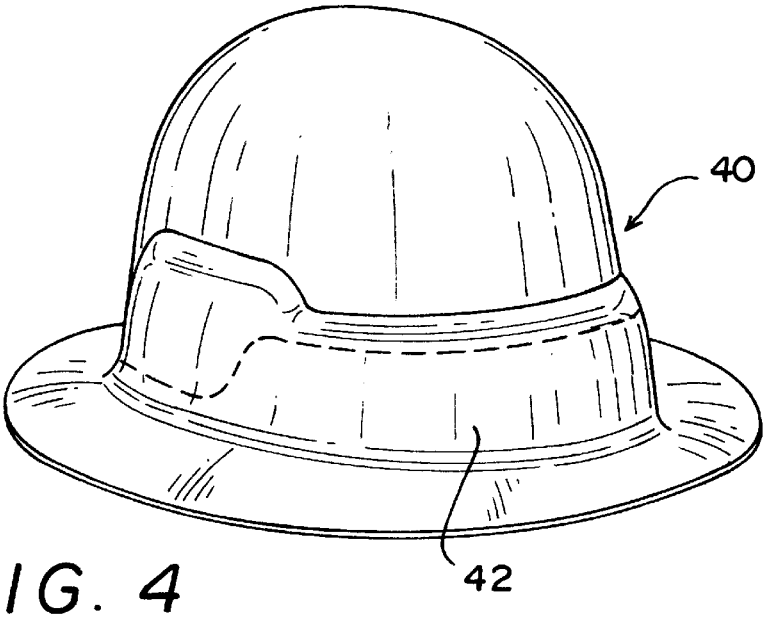
FIG. 4 is a perspective illustration of a helmet formed by the process of FIG. 1, with the outer trim shell material being shown intact.
Figure 5:
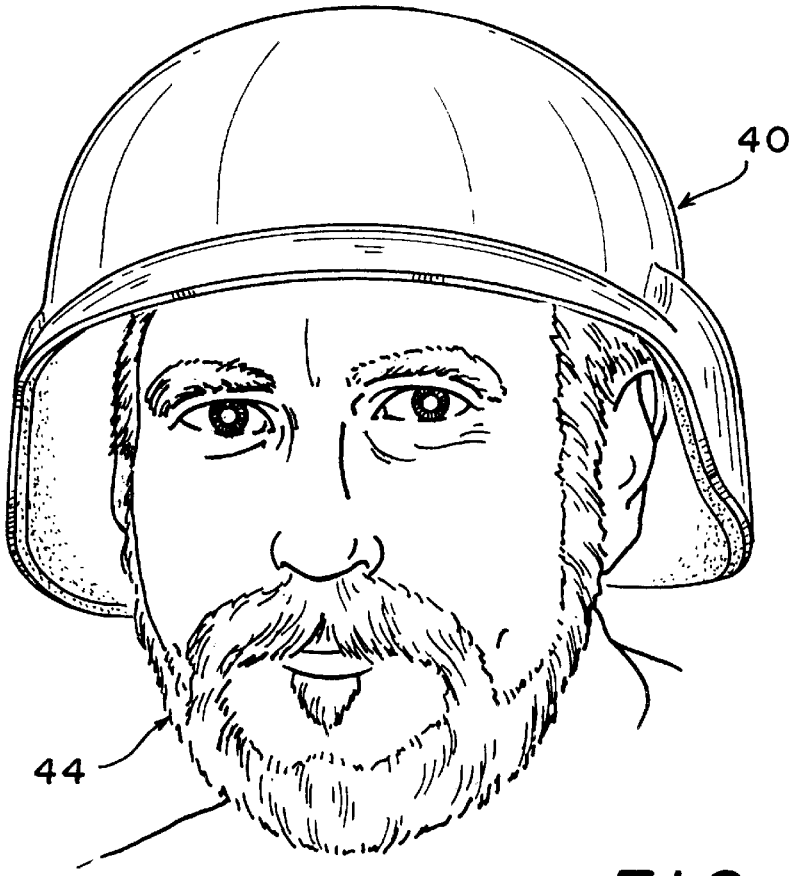
FIG. 5 is a perspective view of a finished helmet, shown mounted upon a test specimen.

Referring now to FIG. 4, a perspective view of a helmet, designated generally as 40, is shown, with trim scrap material 42 shown intact. The helmet product 40 is then cleaned and trimmed to the final form illustrated in FIG. 5, shown mounted upon the test specimen 44.

Figure 6:
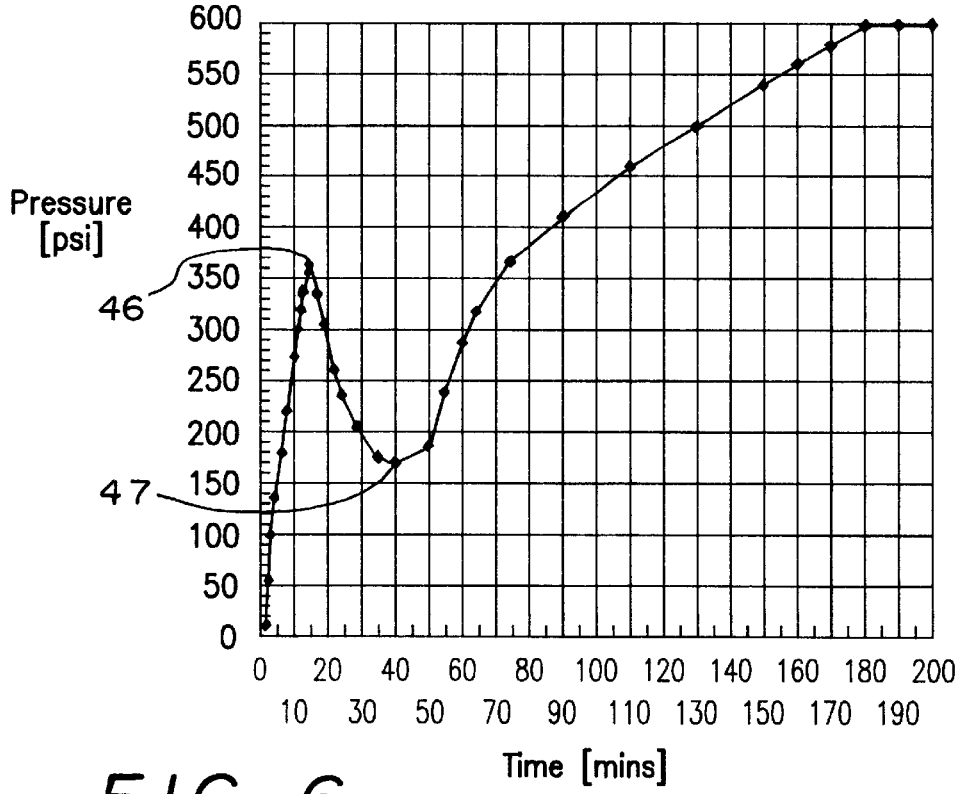
FIG. 6 is a first example of a pressure-time diagram used for helmet forming, in accordance with the principles of the first embodiment, in which there is a pressure drop prior to the final stages of the application of forming pressure.

In the superplastic forming technique shown in FIG. 6, the premachined preform is first heated to a desired superplastic forming temperature. The heated premachined preform is gas-pressure formed with the pressure/time schedule described below:

A first loading zone involves pressurization to an intermediate pressure value (about 360 psi, as shown by numeral designation 46) sufficient to impart an initial curvature of the preform 22 and to achieve sealing of surfaces of the heated premachined preform 22. A second loading zone of pressure decrease from the intermediate pressure value to a local minimum pressure value 47 allows temperature equalization throughout the sealed premachined preform. A third loading zone of pressure increase to a maximum pressure value (600 psi) allows the sealed premachined preform to acquire a fully formed shape of the tool assembly. At a fourth zone, the pressure is held at a maximum value for a specified duration to insure complete maturity of the helmet shape. At this point, curved radii around points of change such as the ear and visor area, etc. are given accurate form.

Figure 7:
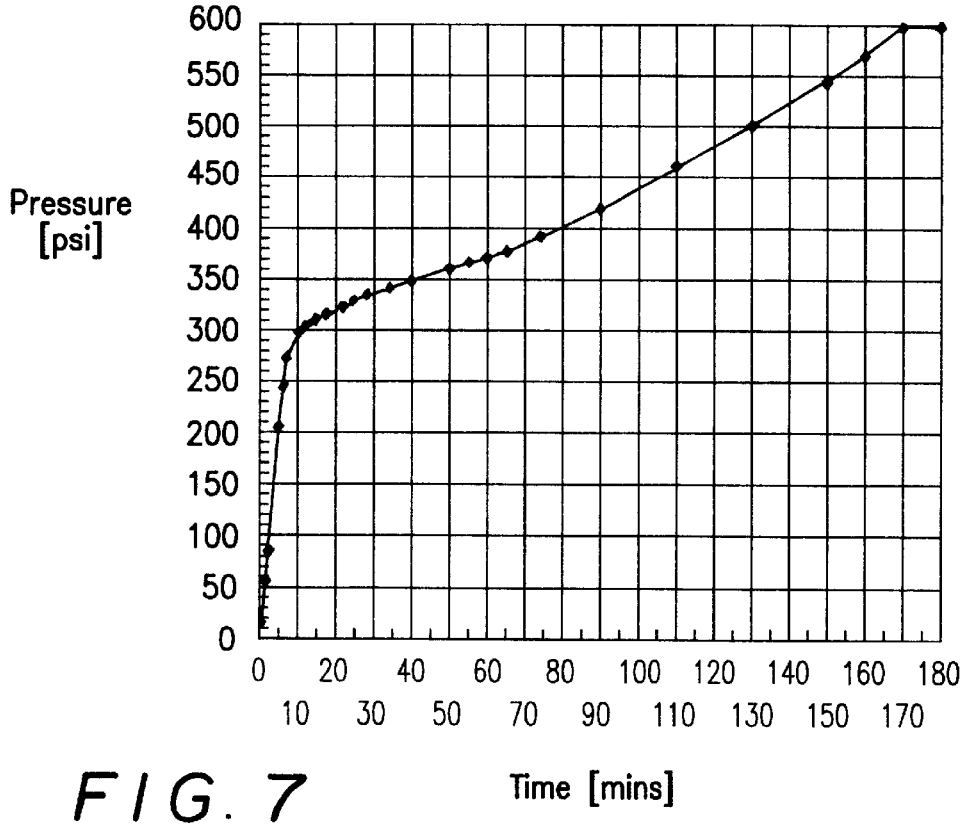
FIG. 7 is a second example of a pressure-time diagram used for helmet forming where the pressure is monotonically rising without a pressure drop.

Referring now to FIG. 7, another example pressure-time graph is shown, in which there is no pressure drop, following the initial increase. Experiments have indicated that the regimes shown in FIGS. 6 and 7 show comparable results, for all practical purposes.

The application of forming gas pressure should be such that the rate of rise of the pressure in the cavity 34 (shown in FIG. 3) limits the strain rate range in the helmet shell so as to avoid localized necking and/or rupture. Optimum strain rate ranges for most titanium alloys are in the range of $10^{-4}$ to $10^{-2}$ [1/sec]. Strain rates well below $10^{4}$ [1/sec] will result in unduly long processing cycles with low productivity and high costs. Such low strain rates can also result in adverse microstructural effects such as grain growth, alpha buildup in the helmet shell wall, etc. Strain rates above $10^{-2}$ [1/sec] tend to increase the risk of part wall rupture. The forming of helmets per the FIG. 1 processing sequence diagrams shown in FIGS. 6 and 7 has been sucessfully achieved. Rupture of the part wall has been avoided. In particular, the FIG. 6 scenario has resulted in a fully formed titanium 6242S helmet with a minimum wall thickness of 0.102 inches and a maximum of 0.257 inches with a trim part weight of about 4 lbs. 4 ozs. These values are "realistic" ranges for acceptable anti-ballistic titanium helmets. Adjustments of these values are achievable through minor changes in the initial preform profile shown in FIG. 2.

Figure 8:
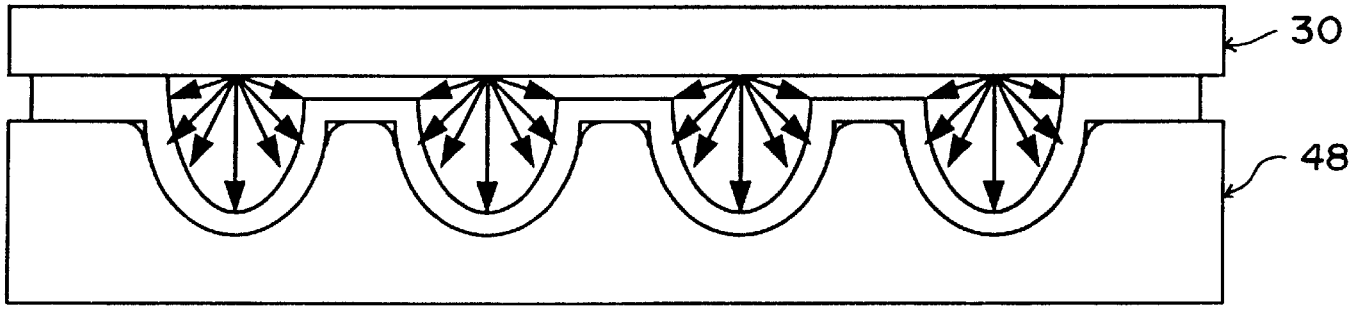
FIG. 8 is a schematic cross-sectional view of a multiple helmet forming female die assembly in accordance with the principles of the FIG. 1 embodiment.

Referring now to FIG. 8, a multiple cavity female die is illustrated, designated generally as 48. This die 48 can be either a single pressure chamber for multiple helmets or each helmet cavity might be an isolated pressure chamber by itself. The latter feature reduces the risk of a multiple helmet failure being scrapped.

Figure 9:
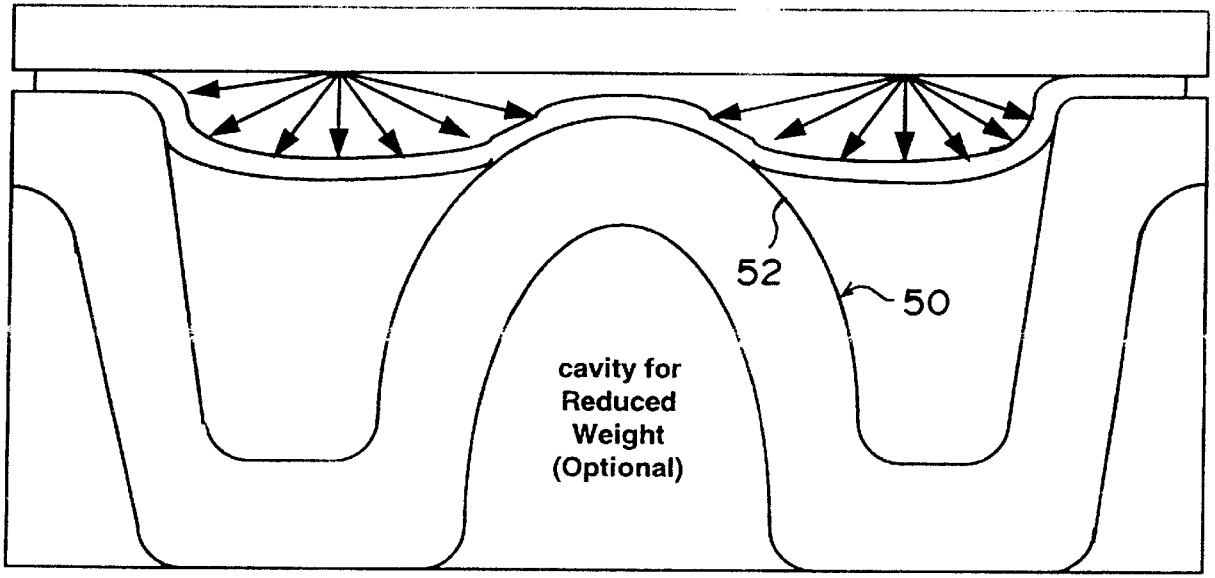
FIG. 9 is a schematic cross-section of a male tool SPF assembly, implementing the process of FIG. 1.

Referring now to FIG. 9, an alternate tooling concept is illustrated in which a male die, designated generally as 50, is utilized. The male die 50 is utilized to form the titanium preform while providing for a more favorable "draft angle" and, hence, less tendency for thinning. This draft angle is designated by numeral designation 52. With this concept, it may be possible to use an initially thinner plate.

Figure 10:
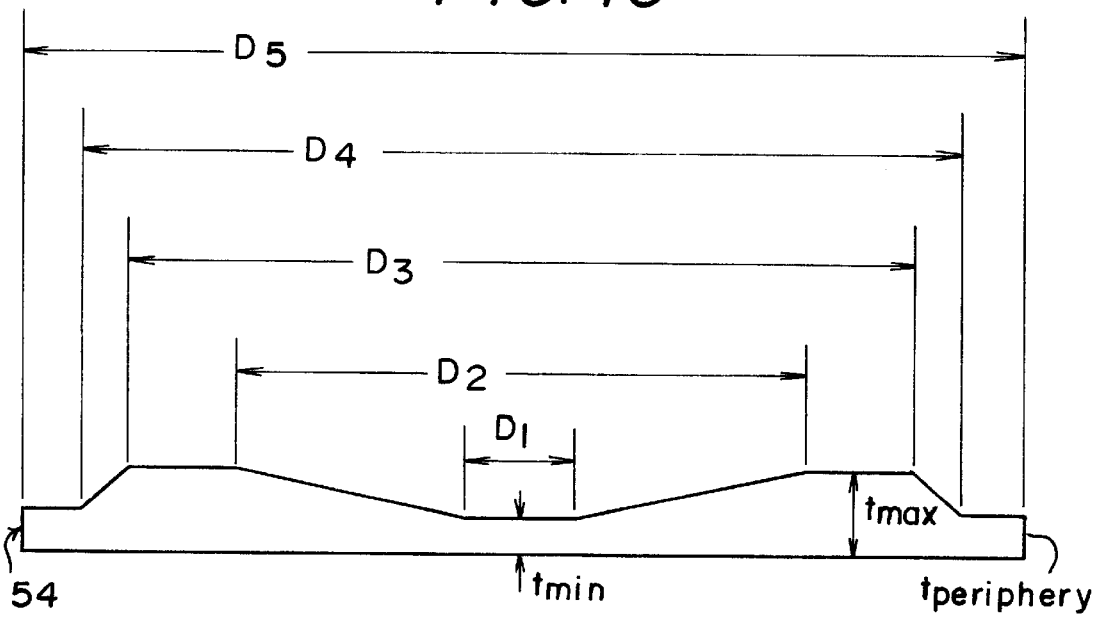
FIG. 10 is a cross-section of a circular preform using the FIG. 1 process, with a male tool.

Referring now to FIG. 10, an alternate preform, designated generally as 54, is illustrated, which is utilized with the male die 50. The preform 54 includes a central region, which is relatively thin ($t_{min}$). A central tapering region is located about the central region. A near periphery region is located about the central tapering region, the near periphery region being relatively thick ($t_{max}$). A peripheral tapering region is located about the near periphery region. A periphery region is located about the peripheral tapering region, the periphery region being relatively thin ($t_{min}$).

The near periphery region has a thickness $t_{max}$ in a broad range from about 0.15 inches to about 0.50 inches. The central region and the peripheral regions have thicknesses, $t_{min}$, $t_{periphery}$, respectively, in a broad range of about 0.085 inches to about 0.375 inches.

Preferably, $t_{max}$ is in a range of about 0.20 inches to about 0.40 inches and $t_{min}$ and $t_{periphery}$ are both in ranges of about 0.10 inches to about 0.315 inches. The male preform 54 central region has a diameter, $D_1$, in a range of about 0 to 5 inches. The near periphery region has an inner diameter, $D_2$, in a range of about 8 to 12 inches, and an outer diameter $D_3$ in a range of about 14–18 inches. The periphery region has an inner diameter $D_4$ in a range of about 15–18 inches and an outer diameter $D_5$ in a range of about 16–20 inches.

Figure 11:
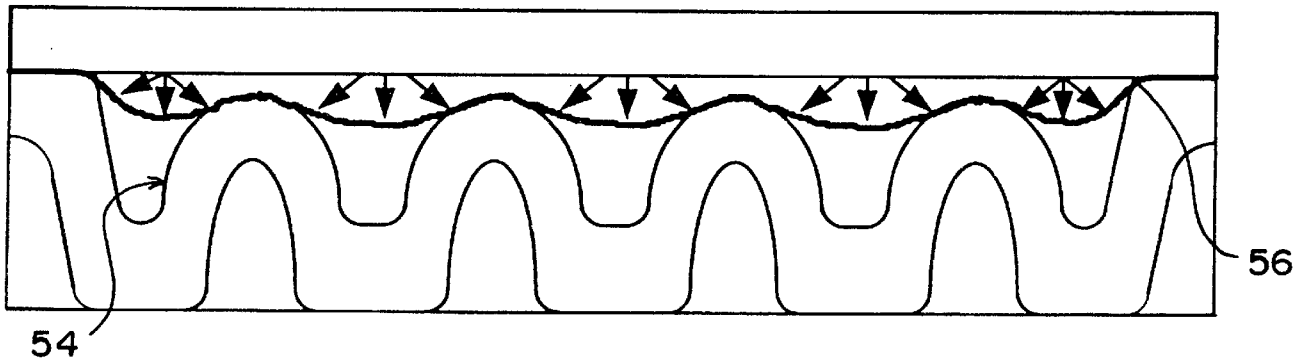
FIG. 11 is a schematic cross-sectional view of a multiple helmet male die assembly.

Referring now to FIG. 11, a multiple male die assembly is illustrated, designated generally as 54. The corner radius 56 should be in the range of 0.25 to 1.5 inches. The draft angle associated with this corner radius preferably should be no less than 10 degrees to minimize friction and thinning at the part corners during superplastic forming.

Figure 12:
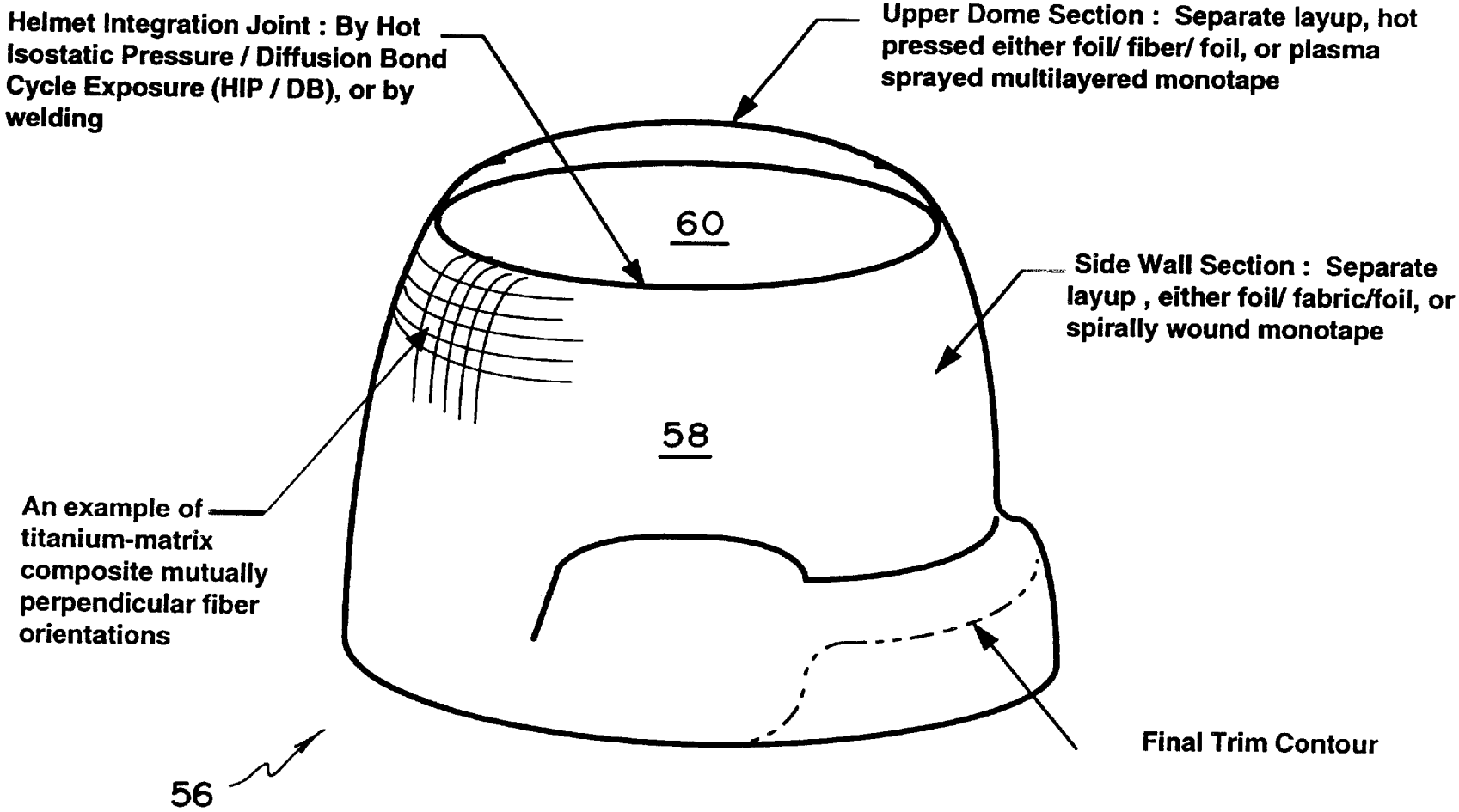
FIG. 12 is a perspective view of a titanium matrix composite (TMC) helmet formed in accordance with the principles of a second embodiment of the present invention.

Referring now to FIG. 12, an alternate ballistic resistant helmet, designated generally as 56 is shown in which the helmet shell comprises a fiber reinforced titanium matrix composite material.

The titanium matrix composite material is preferably double-layer hot isostatically pressed laminate, each layer having a unidirectional multiple plies of titanium alloy/silicon fiber composite. These layers are preferably substantially mutually perpendicular, as shown in this figure. The helmet shell 56 includes a sidewall section 58 formed of a portion of the fiber-reinforced titanium matrix composite material and an upper dome section 60 formed of another portion of the fiber reinforced titanium matrix composite material. The upper dome section 60 is hot isostatically pressed/diffusion bonded to the sidewall section 58. Alternately, the upper dome section may be joined by welding. The helmet 56 may be formed by hot isostatically pressing (HIP'ing) (a first piece of fiber-reinforced titanium matrix composite material to form the sidewall section 58. A second piece of fiber-reinforced titanium matrix composite material is hot pressed to form the upper dome section 60. The sidewall section 58 is then HIP/diffusion bonded to the upper dome sections 60.

Referring now to FIG. 13, a first embodiment of a cross-section of the FIG. 12 helmet is shown. The mutually perpendicular titanium-matrix composite layers are shown, designated as 62, 64. A ductile outer layer 66, formed of hot isostatically pressed monolithic titanium, is metallurgically bonded HIP-diffusion to the layer 64.

Referring now to FIG. 14, the mutually perpendicular layers 68, 70 are shown. A monolithic, titanium, ductile sub-surface strike layer 72 is metallurgically bonded to layer 70. A hardened titanium outer strike layer 74 is obtained by diffusing nitrogen or other interstitial gas into the monolithic titanium layer 72, thus forming a sub-layer of hardened titanium material.

Figure 15:
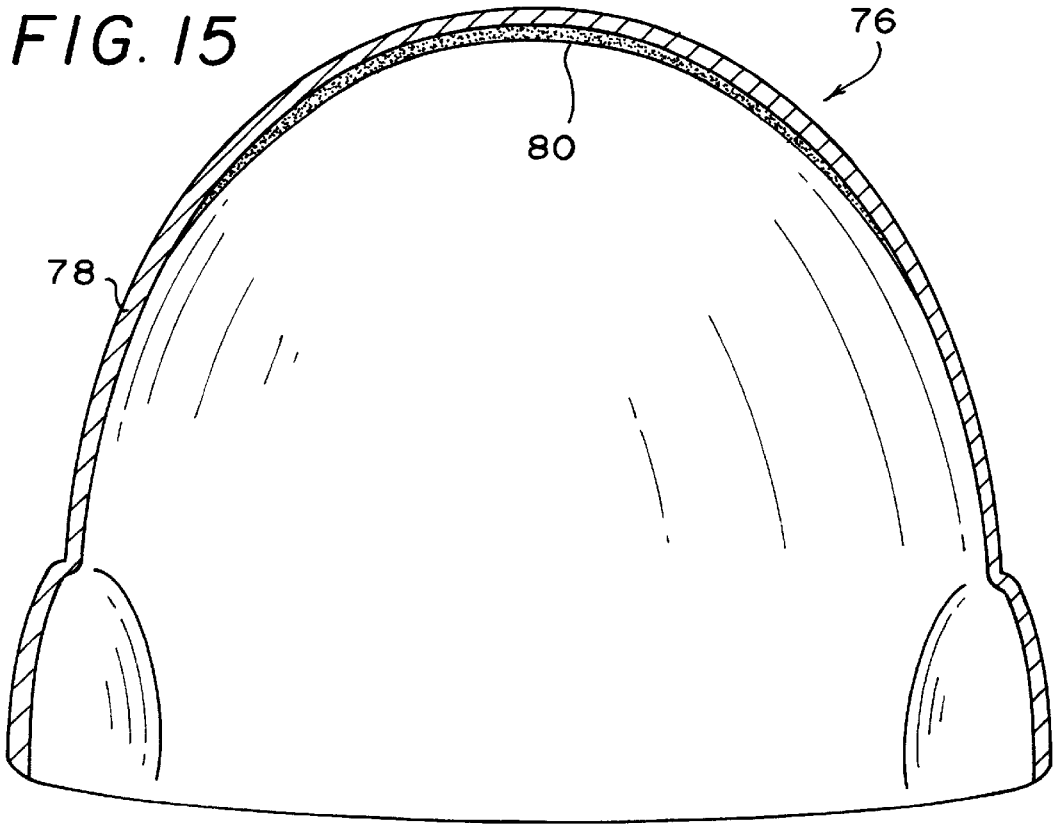
FIG. 15 is a cross-sectional view of a monolithic helmet with a TMC insert bonded therein.

Referring now to FIG. 15, another embodiment of the present invention is illustrated, designated generally as 76. The helmet shell 76 includes a main body portion 78 formed of superplastically formed monolithic titanium-based material and an insert 80 bonded to an inner dome surface of the main body portion 78. The insert 80 is preferably formed of fiber-reinforced titanium matrix composite material.

The monolithic titanium-based material used in this invention is preferably alphabeta titanium alloy. This is used due to its superior superplastic forming characteristics.

It preferably has an aluminum equivalent of 5.8–7.4.

Obviously, many modifications and variations of the present invention are possible in light of the above teachings. It is, therefore, to be understood that, within the scope of the appended claims, the invention may be practiced otherwise than as specifically described.

What is claimed and desired to be secured by Letters Patent of the United States is:

1. A process for forming a ballistic resistant helmet, comprising the steps of:

a) pre-machining a titanium-based alloy preform, comprising:
   i) a central region which is relatively thick;
   ii) a central tapering region about said central region;
   iii) a near periphery region about said central tapering region, said near periphery region being relatively thin;
   iv) a peripheral tapering region about said near periphery region; and
   v) a periphery region about said peripheral tapering region, being relatively thick;

b) mounting said premachined preform to a female tool assembly having a desired helmet shape and mechanically pressing said preform to provide a desired sealing; and c) superplastically forming said premachined preform to a final helmet shape.

2. The process of claim 1, wherein said central region and said periphery region each have thicknesses in a range of from about 0.15 inches to about 0.50 inches; and wherein said near periphery region has a thickness in a range of about 0.085 inches to about 0.375 inches.

3. The process of claim 1, wherein said central region and said periphery region each have thicknesses in a range of from about 0.20 inches to about 0.40 inches; and wherein said near periphery region has a thickness in a range of about 0.10 inches to about 0.315 inches.

4. The process of claim 1, wherein said step of superplastically forming, comprises the steps of:

a) heating said premachined preform to a desired superplastic forming temperature;

b) gas-pressure forming said heated premachined preform with a pressure/time schedule, comprising:
   i) a first loading zone pressurized to an intermediate pressure value sufficient to verify sealing of surfaces of said heated premachined preform and to impart an initial preform curvature;
   ii) a second loading zone of pressure decrease from said intermediate pressure value to a local minimum pressure value to allow temperature equalization throughout said sealed premachined preform;

iii) a third loading zone of pressure increase to a maximum pressure value at which said sealed premachined preform will have acquired a fully formed shape of said female tool assembly; and iv) a fourth zone in which pressure is held at a maximum value for a specified duration to insure complete maturity of the helmet shape.

5. The process of claim 1, wherein:

said control region has a diameter ($D_1$) in a range of 2 to 6 inches;

said near periphery region has an inner diameter ($D_2$) in a range of 7 to 11 inches and an outer diameter ($D_3$) in a range of 9 to 13 inches; and said periphery region has an inner diameter ($D_4$) in a range of 11 to 15 inches and an outer diameter ($D_5$) in a range of 14 to 16 inches.

6. A process for forming a ballistic resistant helmet, comprising the steps of:

a) pre-machining a titanium-based alloy preform, comprising:

i) a central region which is relatively thin;

ii) a central tapering region about said central region;

iii) a near periphery region about said central tapering region, said near periphery region being relatively thick;

iv) a peripheral tapering region about said near periphery region; and v) a periphery region about said peripheral tapering region being relatively thin;

b) mounting said premachined preform to a male tool assembly having a desired helmet shape and mechanically pressing said preform to provide a desired sealing; and c) superplastically forming said premachined preform to a final helmet shape.

7. The process of claim 6, wherein said near periphery region has a thickness in a range of from about 0.15 inches to about 0.50 inches; and wherein said central region and said periphery regions each have thicknesses in a range of about 0.085 inches to about 0.375 inches.

8. The process of claim 6, wherein said near periphery region has a thickness in a range of from about 0.20 inches to about 0.40 inches; and wherein said central region and said periphery regions each have thicknesses in a range of about 0.10 inches to about 0.315 inches, about 0.085 inches to about 0.375 inches.

9. The process of claim 6, wherein said step of superplastically forming, comprises the steps of:

a) heating said premachines preform to a desired superplastic forming temperature;

b) gas-pressure forming said heated premachined preform with a pressure/time schedule, comprising;

i) a first loading zone pressurized to an intermediate pressure value sufficient to verify sealing of surfaces of said heated premachined preform and to impart an initial preform curvature;

ii) a second loading zone of pressure decrease from said intermediate pressure value to a local minimum pressure value to allow temperature equalization throughout said sealed premachined preform;

iii) a third loading zone of pressure increase to a maximum pressure value at which said sealed premachined preform will have acquired a fully formed shape of said male tool assembly; and iv) a fourth zone in which pressure is held at a maximum value for a specified duration to insure complete maturity of the helmet shape.

10. The process of claim 6, wherein:

said control region has a diameter ($D_1$) in a range of 0 to 5 inches;

said near periphery region has an inner diameter ($D_2$) in a range of 8 to 12 inches, and an outer diameter ($D_3$) in a range of 14 to 18 inches; and said periphery region has an inner diameter ($D_4$) in a range of 15 to 18 inches and an outer diameter ($D_5$) in a range of 16 to 20 inches.

11. A process for forming a ballistic resistant helmet, comprising the steps of:

a) hot isostatically pressing (HIP'ing) a first piece of fiber-reinforced titanium matrix composite material to form a side wall section;

b) hot pressing a second piece of fiber-reinforced titanium matrix composite material to form an upper dome section; and c) HIP/diffusion bonding said side wall section to said upper dome section.

* * * * *